US008752565B2

(12) United States Patent
McConnell et al.

(10) Patent No.: US 8,752,565 B2
(45) Date of Patent: Jun. 17, 2014

(54) PORTABLE RECREATIONAL VEHICLE SEASONAL ROLL-UP AWNING SNAP-ROOM AWNING ADDITION

(75) Inventors: Patrick N McConnell, Goshen, IN (US); Jon E Beland, Sturgis, MI (US)

(73) Assignee: Dometic LLC, Elkhart, IN (US)

( * ) Notice: Subject to any disclaimer, the term of this patent is extended or adjusted under 35 U.S.C. 154(b) by 98 days.

(21) Appl. No.: 13/232,097

(22) Filed: Sep. 14, 2011

(65) Prior Publication Data

US 2013/0061895 A1 Mar. 14, 2013

(51) Int. Cl.
*E04H 15/08* (2006.01)

(52) U.S. Cl.
USPC ..... 135/88.1; 52/71

(58) Field of Classification Search
USPC ..... 135/88.1, 88.11, 88.12; 52/71, 243.1; 160/231.1, 231.2
See application file for complete search history.

(56) References Cited

U.S. PATENT DOCUMENTS

| | | | | | |
|---|---|---|---|---|---|
| 2,107,608 | A * | 2/1938 | Hewlett | 135/90 |
| 2,905,281 | A * | 9/1959 | Zitomer | 52/127.1 |
| 3,084,703 | A * | 4/1963 | Lefebvre et al. | 135/91 |
| 3,241,273 | A * | 3/1966 | Struben | 52/63 |
| 3,742,669 | A * | 7/1973 | Mansfeld | 52/396.07 |
| 4,102,353 | A * | 7/1978 | Pugliese | 52/16 |
| 4,195,877 | A * | 4/1980 | Duda | 296/172 |
| 4,686,805 | A | 8/1987 | Forslin | |
| 4,726,153 | A * | 2/1988 | Adler et al. | 52/63 |
| 5,486,391 | A * | 1/1996 | Tyner | 428/44 |
| 5,549,129 | A * | 8/1996 | Becker | 135/88.15 |
| 5,579,616 | A | 12/1996 | Farag | |
| 5,617,682 | A | 4/1997 | Christopher | |
| 5,718,253 | A | 2/1998 | McNamee | |
| 6,006,811 | A * | 12/1999 | Brutsaert | 160/71 |
| 6,176,050 | B1 * | 1/2001 | Gower | 52/222 |
| 6,484,739 | B1 * | 11/2002 | Sofie et al. | 135/117 |
| 6,564,850 | B1 * | 5/2003 | Chen | 160/231.1 |
| 7,100,625 | B2 | 9/2006 | Valles | |
| 2008/0163563 | A1 * | 7/2008 | Sciglia | 52/63 |
| 2011/0155197 | A1 * | 6/2011 | Hicks et al. | 135/96 |

* cited by examiner

*Primary Examiner* — Noah Chandler Hawk
(74) *Attorney, Agent, or Firm* — Pearne & Gordon LLP

(57) ABSTRACT

A partition includes a plurality of panels and an elongate panel joiner. The plurality of panels includes a first panel and a second panel that are adjacent about one another. The elongate panel joiner joins the first panel and the second panel. The panel joiner includes two end members and a corrugated portion there between. The end members are configured along opposite ends of the panel joiner. One of the two end members is configured to connect to the first panel and the other of the two end member is configured to connect to the second panel. The corrugated portion is configured such that the panel joiner can move in an accordion-like manner.

16 Claims, 9 Drawing Sheets

PORTABLE RECREATIONAL VEHICLE SEASONAL ROLL-UP AWNING SNAP-ROOM AWNING ADDITION

TECHNICAL FIELD

The present disclosure relates generally to a roof structure of an inhabitable structure and, more specifically, to a room for assembly under and with the roof structure of the inhabitable structure.

BACKGROUND

Awnings that are part of an inhabitable structure, such as a residence, a motor home, a recreational vehicle or the like, provide shelter in an outdoor environment. It may be possible to form walls that surround the space below the awning so as to provide an enclosed, room-like space that is secluded from the outdoors. However, these rooms might require the use of fastening means such as screws, nuts, bolts or the like for assembly and it might also be cumbersome to assemble or disassemble the room if the components were connected using these fastening means. Moreover, these rooms might not be able to compensate for the conditions of the ground having undulations and irregularities and gaps may exist between the walls of the rooms and the ground. Thus, there is a need for a room that helps reduce the shortcomings of the apparatuses known in the art.

SUMMARY

In one example aspect, a partition includes a plurality of panels and an elongate panel joiner. The plurality of panels includes a first panel and a second panel that are adjacent about one another. The elongate panel joiner joins the first panel and the second panel. The panel joiner includes two end members and a corrugated portion there between. The end members are configured along opposite ends of the panel joiner. One of the two end members is configured to connect to the first panel. The other of the two end members is configured to connect to the second panel. The corrugated portion is configured such that the panel joiner can move in an accordion-like manner.

In another example aspect, the panels are rectangular. The one of the two end members is configured to connect to a first longitudinal edge of the first panel. The other of the two end members is configured to connect to a second longitudinal edge of the second panel.

In yet another example aspect, the corrugated portion is configured to extend and retract such that a distance between the end members is variable and the end members are capable of assuming either parallel or non-parallel orientations.

In yet another example aspect, the corrugated portion allows the first panel and the second panel to be moved to orientations where the first panel and the second panel are not coplanar.

In yet another example aspect, each of the plurality of the panels includes a panel frame formed along a periphery of each panel. The panel frame is configured with a first element of a first detachable connection.

In yet another example aspect, the end members are configured with a second element of the first detachable connection. The second element is configured to detachably connect to the first element of the panel frame. The first detachable connection is a snap-in connection.

In yet another example aspect, the partition includes a top rail and a bottom rail such that the plurality of panels can be placed there between. Each of the top rail and the bottom rail is configured with a second element of the first detachable connection. The second element is configured to detachably connect to the first element of the panel frame. The first detachable connection is a snap-in connection.

In yet another example aspect, the plurality of panels includes a third panel. Each of the top rail and the bottom rail includes a track. The third panel is mounted between the top rail and the bottom rail such that the first element of the panel frame of the third panel engages the track. The first element is slidably movable relative to the track such that the third panel can operate as a sliding door. The third panel is not connected to a panel joiner.

In yet another example aspect, the panel joiner connects the first and second panels while oriented in a substantially vertical manner.

In yet another example aspect, the bottom rail includes an inclined surface configured to channel liquid to a drainage aperture.

In yet another example aspect, the top rail and the bottom rail substantially mirror one another in shape and defining a footing of the partition.

In yet another example aspect, an assembly forms an enclosed area adjoining an inhabitable structure that includes awning roof structure and a wall surface. The assembly includes a partition and a panel joiner. The partition includes a plurality of panels including a first panel and a second panel. The enclosed area is bounded laterally by the partition and the wall surface and bounded at a top by the roof structure. At least two adjacent panels are detachably connected with one another and the partition is detachably connected to the roof structure. The panel joiner is configured to detachably connect the first panel and the second panel. The panel joiner includes two end members and a corrugated portion there between. The end members are configured along opposite ends of the panel joiner. One of the two end members is configured to connect to the first panel. The other of the two end members is configured to connect to the second panel.

In yet another example aspect, the roof structure is configured as an awning.

In yet another example aspect, the panels are rectangular. The one of two end members is configured to connect to a first longitudinal edge of the first panel. The other of the two end members is configured to connect to the second panel.

In yet another example aspect, the corrugated portion is configured to extend and retract such that a distance between the end members is variable.

In yet another example aspect, the corrugated portion is configured to extend and retract such that the end members are capable of assuming either parallel or non-parallel orientations.

In yet another example aspect, each of the plurality of the panels are provided with a panel frame formed along a periphery of each panel. The panel frame is configured with a first element of a first detachable connection.

In yet another example aspect, the end members are configured with a second element of the first detachable connection. The second element is configured to detachably connect to the first element of the panel frame. The first detachable connection is a snap-in connection.

In yet another example aspect, the partition includes a top rail and a bottom rail such that the plurality of panels can be placed there between. Each of the top rail and the bottom rail is configured with a second element of the first detachable connection. The second element is configured to detachably connect to the first element of the panel frame. The first detachable connection is a snap-in connection.

In yet another example aspect, the top rail and the bottom rail substantially mirror one another in shape and defining a footing of the partition.

In yet another example aspect, the plurality of panels includes a third panel. Each of the top rail and the bottom rail includes a track. The third panel is mounted between the top rail and the bottom rail such that the first element of the panel frame of the third panel engages the track. The first element is slidably movable relative to the track such that the third operates as a sliding door. The third panel is not connected to the panel joiner.

In yet another example aspect, the assembly further includes a platform on which the partition is mounted.

In yet another example aspect, the partition includes terminal edges abutting against the wall surface. Each of the terminal edges includes a seal with flaps that can diverge and contact the wall surface.

In yet another example aspect, the assembly includes a first patch and a second patch defining a second detachable connection. The first patch and the second patch are configured to detachably connect with one another. The first patch and the second patch include an adhesive surface configured to be adhered to a part of the assembly.

In yet another example aspect, the roof structure is connected to the top rail through the second detachable connection.

In yet another example aspect, the assembly further includes a fabric element configured to conceal an opening between the roof structure and the top rail. The fabric element is connected to the awning through the second detachable connection and is connected to the top rail through a third detachable connection.

In yet another example aspect, the third detachable connection is a snap-in connection.

BRIEF DESCRIPTION OF THE DRAWINGS

These and other aspects are better understood when the following detailed description is read with reference to the accompanying drawings, in which.

DETAILED DESCRIPTION

Figure 1:
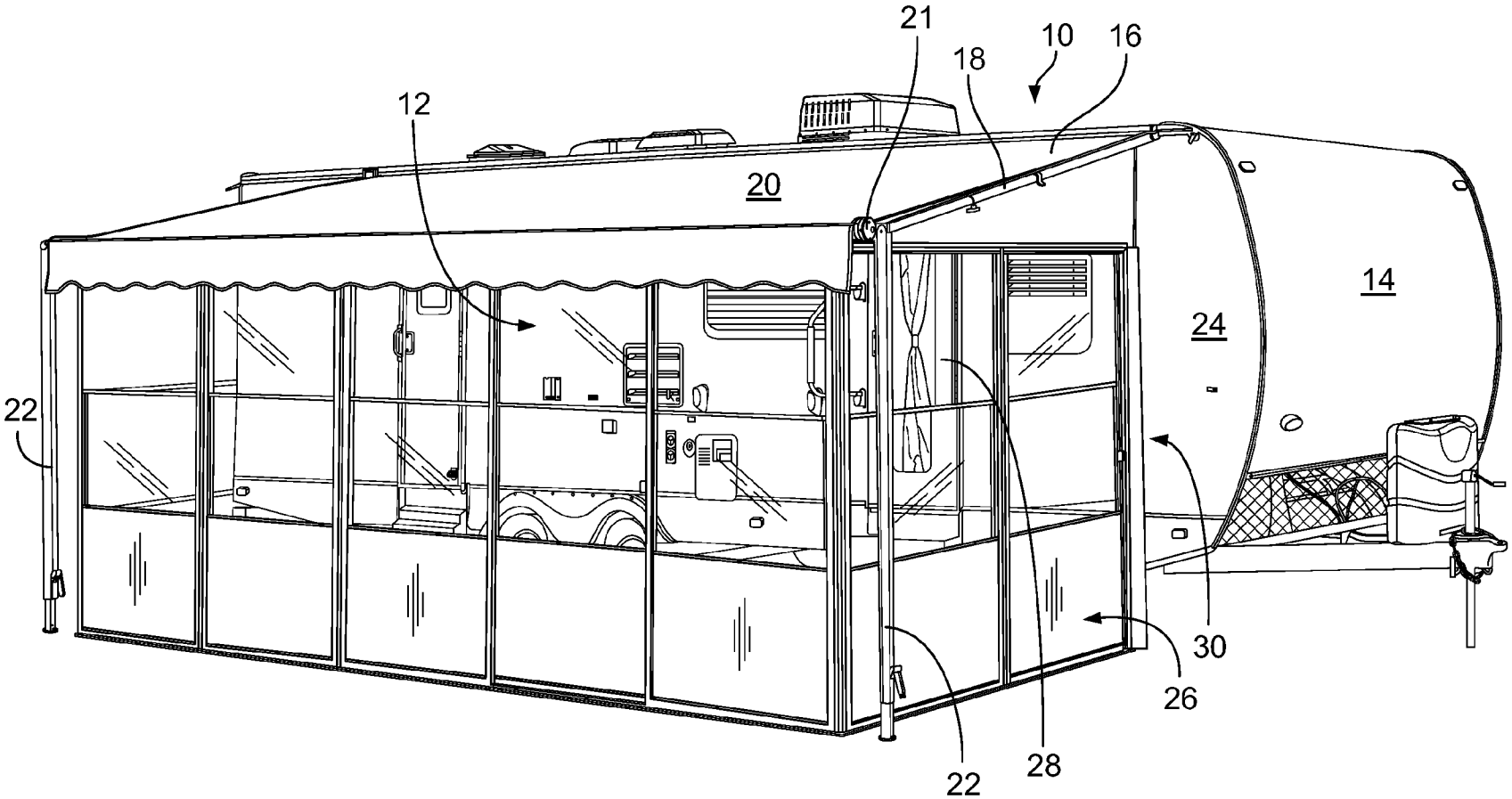
FIG. 1 is a perspective view of an example inhabitable structure with an example awning below which is an example embodiment of a room defining an enclosed area.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

Referring now to FIG. 1, an example embodiment of a room 10 defining an enclosed area 12 adjoining an inhabitable structure 14 is shown. While the example inhabitable structure 14 shown in FIG. 1 is a caravan or a trailer, the inhabitable structure 14 may also be a residential or commercial building, a motor home, a recreational vehicle, a camper or the like. The inhabitable structure 14 may include a roof structure 16 such as an awning that may extend and retract (e.g., by winding and unwinding a canopy 20 around a roller tube 21) from a wall surface 24 based on the needs of an operator, weather conditions, etc. Instead of an awning, the roof structure 16 may be a built-in, fabric roof structure on top of the room 10 defining an enclosed area 12 that adjoins the inhabitable structure 14. The roof structure 16 may include members 18 that enable the extension and refraction of the canopy 20 and columns 22 that extend downwardly and vertically support the roof structure 16. It may also be possible to create a room 10 with an enclosed area 12 next to a wall provided with a fabric roof structure 16 instead of an inhabitable structure 14.

Figure 2:
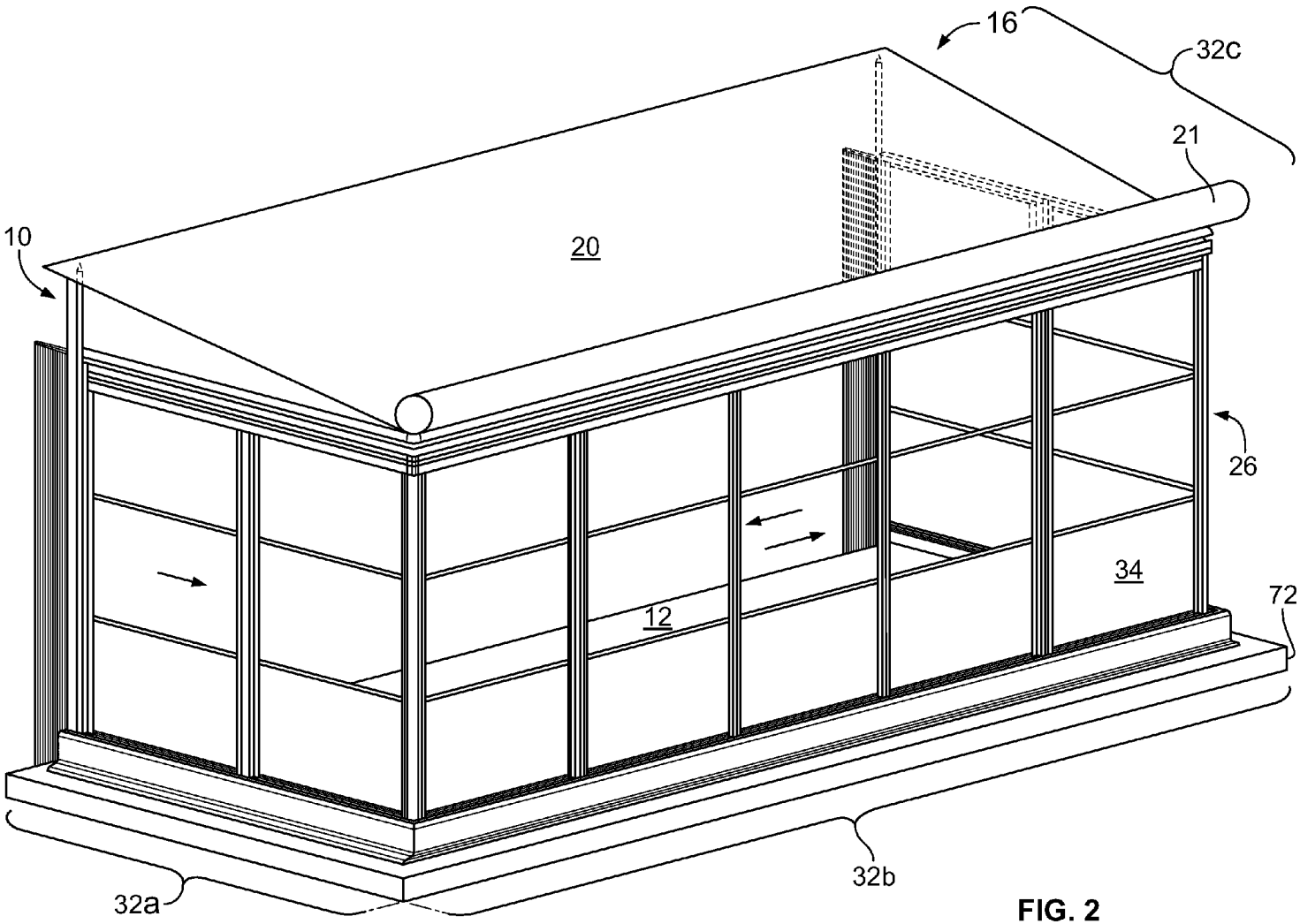
FIG. 2 is a schematic view of the room in an isolated state with a partition partly defining the enclosed area.

FIG. 2 illustrates the room 10, isolated from the inhabitable structure 14, in a more schematic manner. The room 10 is bounded at the top by the roof structure 16 which extends from the inhabitable structure 14. As shown in FIGS. 1-2, the area 12 below the roof structure 16 may be substantially enclosed on lateral sides in part by the wall surface 24 of the inhabitable structure 14 (omitted from FIG. 2) and in part by a partition 26. The wall surface 24 is part of the inhabitable structure 14 and may be flat, curved or shaped differently. The wall surface 24 may include a door 28 allowing access to the room 10 from the interior of the inhabitable structure 14. The partition 26 may be a screen-like component the terminal edges 30 of which may be placed to abut against the wall surface 24 of the inhabitable structure 14 to form the enclosed area 12. The partition 26 may be dimensioned to substantially fit within a vertical footing of the roof structure 16. Moreover, the partition 26 may be bendable at certain parts so as to be divided into wall segments 32*a*, 32*b* and 32*c* that make up the multiple facets of the partition 26 (i.e., the outer walls of the room 10).

The partition 26 may be formed of a plurality of rectangular panels 34 (FIG. 3A) that may be detachably connected along its lateral or longitudinal edges with neighboring components. A panel 34 may have dimensions similar to those of a door so that it is sufficiently large to allow an adult to pass through. Each panel 34 may include an outer section which is a four-sided, panel frame 36 formed along the periphery of the panel 34. Thus, the panel 34 may include lateral edges 34*a*, a top edge 34*b* and a bottom edge 34*c*. As shown in FIGS. 3B-3C, the panel frame 36 includes a plurality of wall-like protrusions 38 allowing the panel frame 36 to be detachably connected to neighboring components. FIG. 3B shows a cut-out, segmented portion of the panel frame 36 detached from the neighboring components while FIG. 3C shows a cross-section along one of the sides of the panel frame 36.

The panel frame 36 may be configured with a first element 40 while a component configured for connection with the panel frame 36 may be configured with a second element 42. The first element 40 and the second element 42 can mate or interlock to form a first detachable connection. In this example embodiment, the first element 40 may be a female element which is a first set of outward protrusions 39 with recesses 44 (FIG. 3B) formed on interior surfaces 39*a* of the outward protrusions 39 in a snap-in connection. The second element 42 may be a male element which is a second set of outward protrusions 46 (FIGS. 4B, 5B and 6B) in a snap-in connection. The male element 42 may include lateral projections 46*a* on exterior surfaces 46*b* of the second set of outward protrusions 46. In this embodiment, the panel frame 36 is configured with the first element 40 which is the female element and the components connecting with the panel frame are configured with the second element 42 which is the male element. Alternatively, the first element 40 may be the male element while the second element 42 may be the female element. Moreover, the panel frame 36 may also include an additional wall-like protrusion that can serve as a handle 48.

Figure 3A:
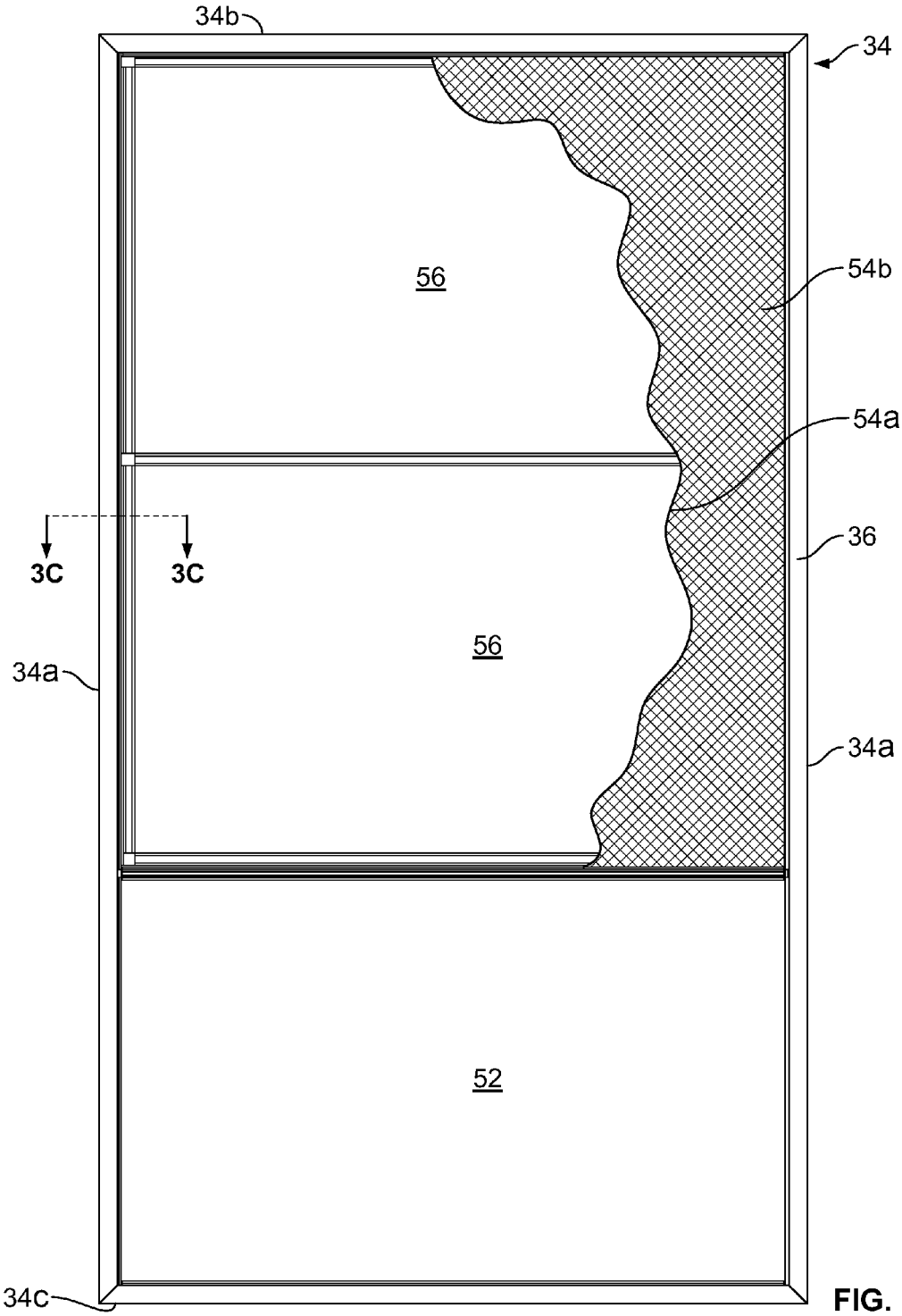
FIG. 3A is a front view of an example embodiment of a panel that is part of the partition.
Figure 3B:
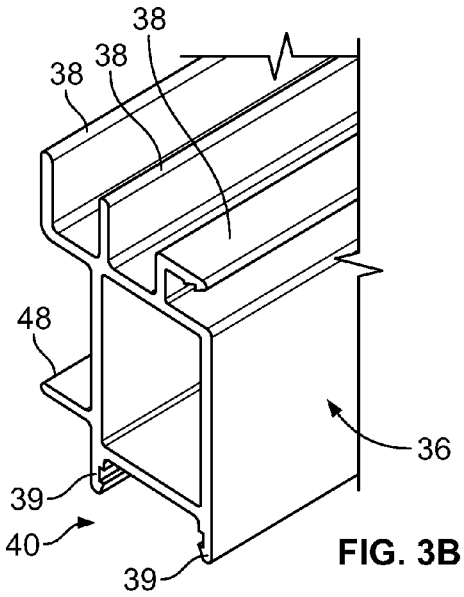
FIG. 3B is a perspective view of a cut-out portion of a panel frame of the panel.
Figure 3C:
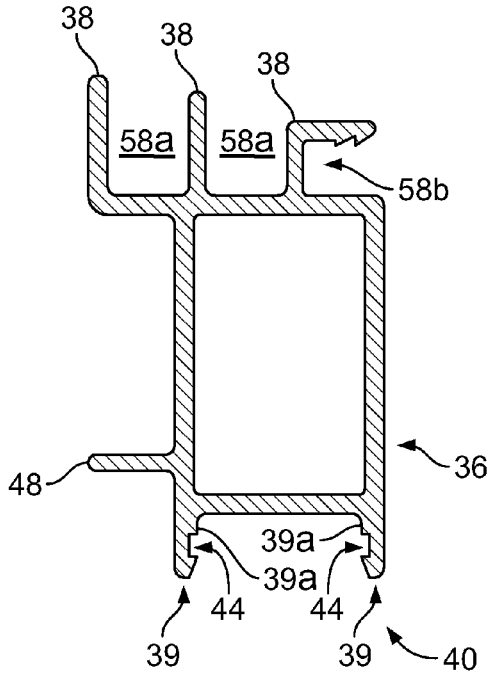
FIG. 3C is a view of a cross-section of the panel frame.

Interiorly of the outer section, as shown in FIG. 3A, the panel 34 may include an inner section made up of a fabric section 52 and a see-through, two-tier section which may include a window pane tier 54*a* and a screen mesh tier 54*b* that are on top of one another. The window pane tier 54*a* may be made up of two or more of window panes 56 that can slide relative to one another within first grooves 58*a* provided on the panel frame 36 (FIG. 3C) thereby allowing air from outside to enter the room through the screen mesh tier 54*b*. The screen mesh tier 54*b* may prevent insect or the like from entering the room when one of the window panes 56 is slid open. The screen mesh tier 54*b* and the fabric section 52 may be secured through a second groove 58*b* provided on the panel frame 36. In the example embodiment, one-third bottom of the inner section is covered by the fabric section 52 while two-thirds of the inner section is covered by the two-tier section 54. It may be possible to move the window panes 56 to a partially open position or a fully open position at which the window panes 56 would overlap with the fabric section 52. Features such as spring clips may be used to keep the window panes 56 still about the panel frame 36 after the window panes 56 are moved up or down.

Figure 4A:
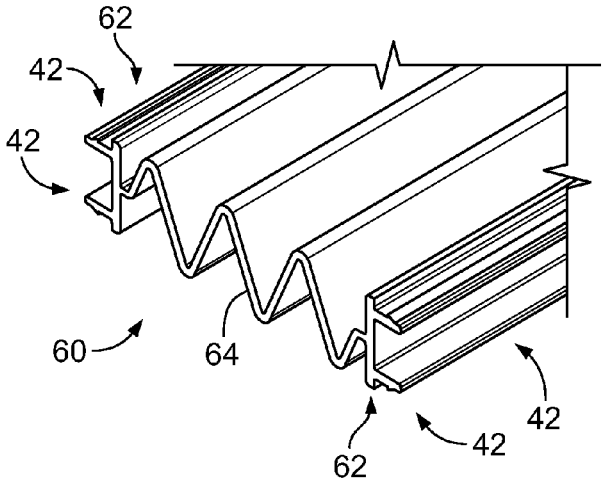
FIG. 4A is a perspective view of a portion of a elongate panel joiner.
Figure 4B:
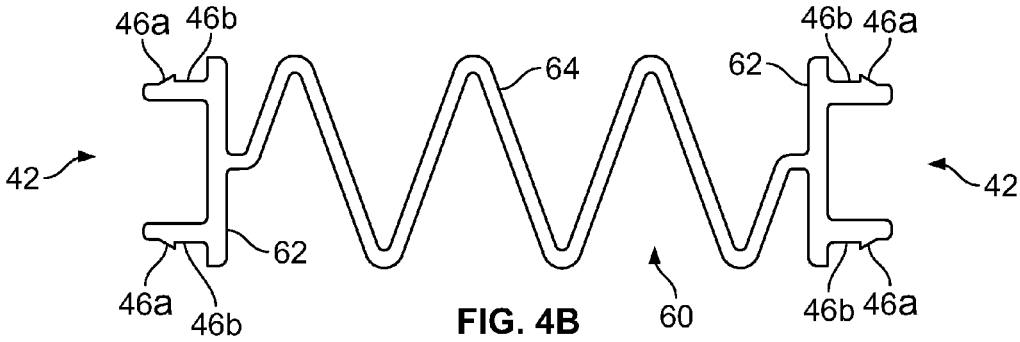
FIG. 4B is a top view of the elongate panel joiner.

A panel 34 is detachably joined along the lateral edges 34*a* with an adjacent panel 34 using an elongate panel joiner 60 (FIGS. 4A-4B). The panel joiner 60 may be used to connect two adjacent panels 34 and may be slightly shorter than the panels 34 lengthwise. When two adjacent panels 34 are configured to move about one another (e.g., when the panels 34 are configured to move past one another as will be described below), the panel joiner 60 is not be suitable for connecting two adjacent panels 34 because the range of movement is limited by the extent to which the panel joiner 60 can stretch. The panel joiner 60 includes two elongate end members 62 located on opposite ends and a flexible, corrugated portion 64 that link the end members 62 therebetween. The panel joiner 60 may be oriented in a substantially vertical manner between two panels 34. The end members 62 of the panel joiner 60 may be configured with the male element 42 of the first detachable connection which can mate with or connect to the female element 40 which may be configured along the lateral or longitudinal edge 34*a* of the panel 34.

The corrugated portion 64 is shaped similar to bellows and allows the elongate panel joiner 60 to move like an accordion and extend and retract. Specifically, as the corrugated portion 64 extends and retracts, the distance between the end members 62 can vary while the end members 62 are oriented parallel to one another. The cross-section of the elongate panel joiner 60 may vary in length from ¾ inches to 3 inches, for example. Moreover, the corrugated portion 64 can be moved such that a top (or a bottom) part of the corrugated portion 64 is wider than a bottom (or a top) part of the corrugated portion 64 and such that the end members 62 are angled about one another and assume non-parallel positions. Furthermore, while the cross-section of the elongate panel joiner 60 in FIG. 4B is shown to be substantially linear, the elongate panel joiner 60 may be bent such that the cross-section assumes non-linear positions and such that the panels 34 connected by the elongate panel joiner 60 are not coplanar. A panel joiner 60 that is located at a part of the partition 26 forming a corner of the room 10 would assume such a non-linear position and form a 90-degree angle, for example.

Figure 7B:
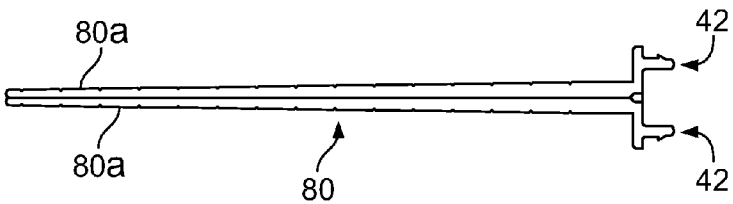
FIG. 7B is a side view of the wall seal.
Figure 7A:
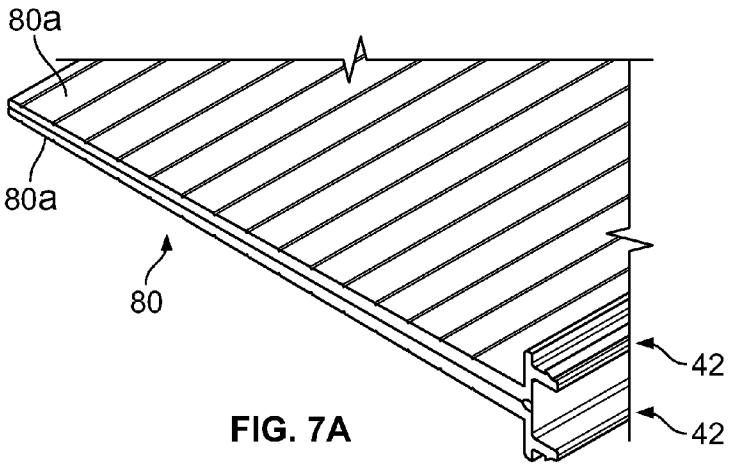
FIG. 7A is a perspective view of a portion of a wall seal.

At the terminal edges of the partition 26 that are configured to be placed near the wall surface 24, the outer female elements 40 on the outermost panels 34 are configured to mate with a wall seal 80 (FIGS. 7A-7B). The wall seal 80 includes a second element 42 that allows the wall seal 80 to be secured to the partition 26 on one end (via the first element 40 of the panel frame 36) and a pair of flexible flaps 80*a* that can diverge and be spread apart on the other end. The flaps 80*a* abut against the wall surface 24 and can close off the gap upon contact between the partition 26 and the wall surface 24.

Figure 5A:
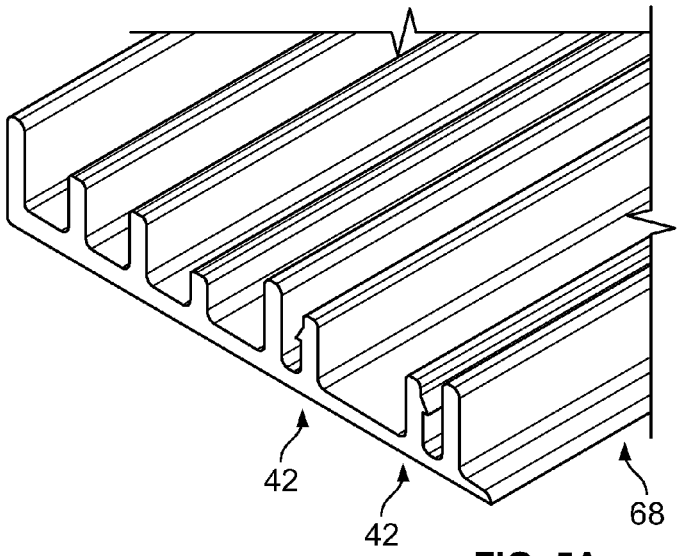
FIG. 5A is a perspective view of a cut-out portion of a bottom rail.

The partition 26 can further include a top rail 66 (FIGS. 6A-6B) and a bottom rail 68 (FIGS. 5A-5C) that make up the top section and the bottom section of the partition 26. The panels 34 connected by the panel joiners 60 are configured to be placed between the top rail 66 and the bottom rail 68. The top rail 66 and the bottom rail 68 define the outer periphery of the room 10 substantially mirroring one another in overall shape and extending around the sides of the room 10. The top rail 66 and the bottom rail 68 may be elongate, board-like components and may, for example, be arranged so as to have a substantially U-shaped footing with the corners being formed of mitered joints.

Figure 5B:
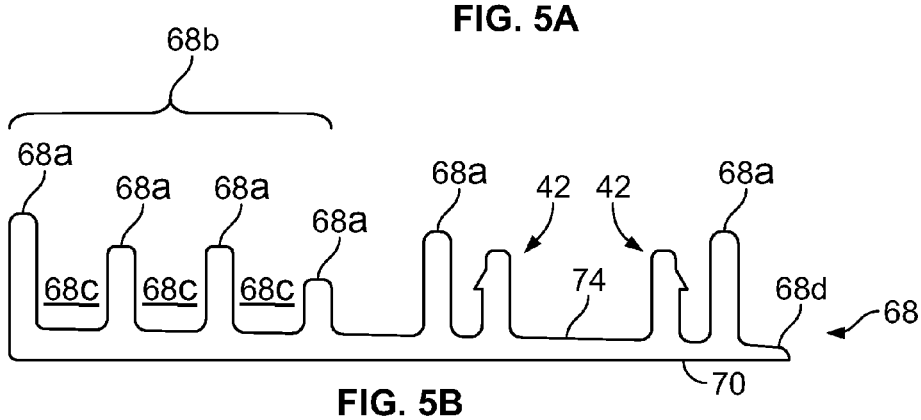
FIG. 5B is a side view of the cut-out portion of the bottom rail.
Figure 5C:
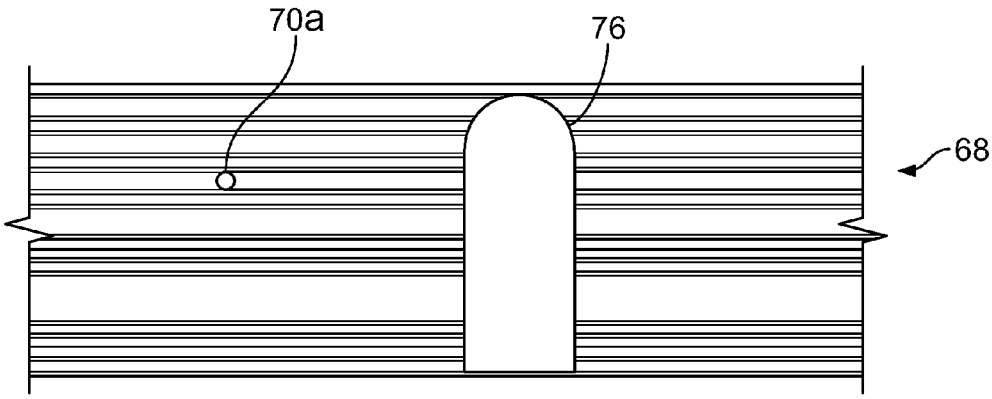
FIG. 5C is a top view of the bottom rail.
Figure 6B:
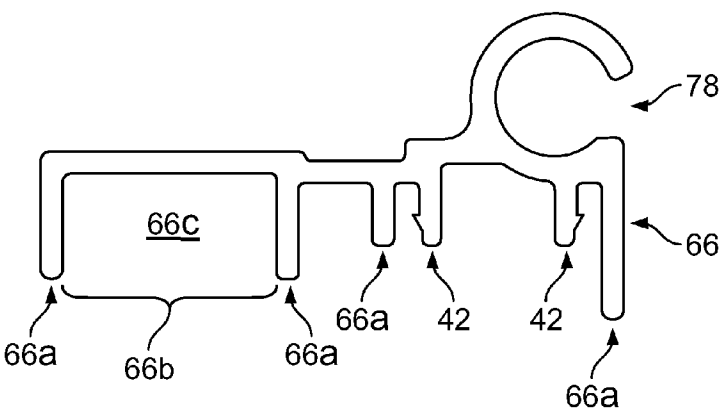
FIG. 6B is a side view of the cut-out portion of the top rail.
Figure 6A:
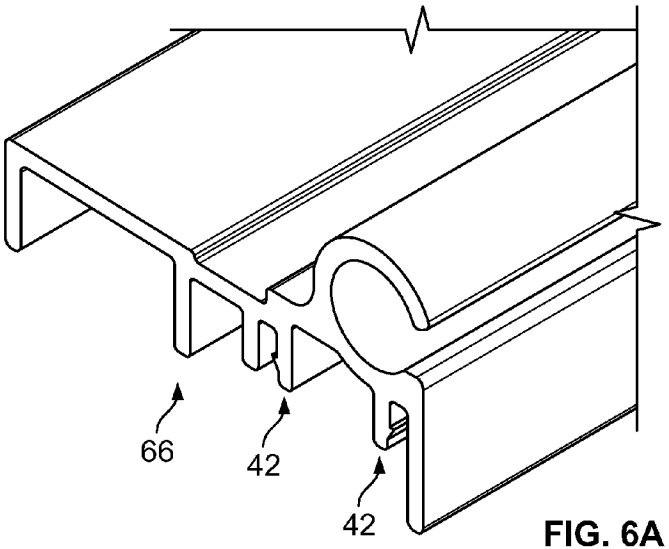
FIG. 6A is a perspective view of a cut-out portion of a top rail.

The top rail 66 may include a plurality of wall-like protrusions 66*a* and the male element 42 of the first detachable connection. The male element 42 on the top rail 66 is configured to mate with the female element 40 on the panel frame 36. Similarly, the bottom rail 68 may include a plurality of wall-like protrusions 68*a* and the male element 42 of the first detachable connection. The top rail 66 and the bottom rail 68 are configured to be positioned, as shown in FIGS. 5B and 6B, so that the panels 34 may be fitted between the top rail 66 and the bottom rail 68 with the female element 40 at the top edge 34*b* and bottom edge 34*c* of the panels 34 mating with the male element 42 of the top rail 66 and the bottom rail 68 respectively. The panels 34 can be secured between the top rail 66 and the bottom rail 68 using a first detachable connection (e.g., a snap-in connection) in this manner.

Alternatively, it is possible to mount the panels 34 between different sections of the top rail 66 and the bottom rail 68, i.e., between a top track 66*b* and a bottom track 68*b* (FIGS. 5A-5B and 6A-6B). The top track 66*b* and the bottom track 68*b* may be one or more grooves formed by one or more wall-like protrusions 66*a*, 68*a* on the top rail 66 and the bottom rail 68 respectively. In this embodiment, the top track 66*b* is a single groove 66*c* formed by two of the protrusions 66*a* on the top rail 66 while the bottom track 68*b* may include three grooves 68*c* formed by the four of the protrusions on the bottom rail 68. The second set of outward protrusions 39 of the female element 40 on the panel frames 36 may be inserted into the single groove 66*c* or the plurality of grooves 68*c*. Unlike the male element 42, no lateral projections are provided on exterior surfaces of the plurality of protrusions of the bottom track

68*b* such that the protrusions 46 of the female element 40 can slide in an unhindered manner past the protrusions 66*a* of the top track 66*b* and the protrusions 68*a* of the bottom track 68*b*. In this manner, the panel 34 mounted between the top track 66*b* and the bottom track 68*b* can operate as a sliding door. Such a panel 34 cannot be connected along the lateral edges 34*a* to the elongate panel joiner 60 since the elongate panel joiner 60 would restrict the movement of the sliding door. Moreover, the partition 26 may be provided with one or more of the above-discussed sliding doors.

The wall-like protrusions 68*a* of the bottom rail 68 may project from a base 70 which may be laid on the ground or a platform 72 (e.g., a wooden deck or a concrete pad, as shown in FIG. 2). The platform 72 need not be provided as part of the assembly of the room 10 and may be procured by an end user. The base 70 may include apertures 70*a* by which the bottom rail 68 may be secured with respect to the platform 72 using fastening means known in the art such as nails, fasteners or the like. An upper surface 74 of the base 70 may also be inclined so as to channel liquids toward an exterior end 68*d* of the bottom rail 68. The base 70 may further include one or more drainage apertures 76 through which the liquids are drained out of the bottom rail 68.

The roof structure 16 is secured to the partition 26 in the following manner. The roller tube or awning rail 21 includes a groove 82 in which a bead section 84 of a valance 86 can be inserted so as to removably secure the valance 86 to the roller tube 21. Moreover, the valance 86 and the top rail 66 may be fastened to one another using a fastener 92. The fastener 92, which can serve as a second detachable connection, may include a first patch 88 and a second patch 90 that are configured with connective surfaces including members that can become detachably tangled with one another. This occurs where the first and second patches 88, 90 are pushed against one another with the connective surfaces facing each other. The fastener 92 may be a fastener with hooks and loops (e.g., Velcro™), a reclosable fastener with mushroom shaped stems (e.g., Dual Lock™), or the like.

Figure 8:
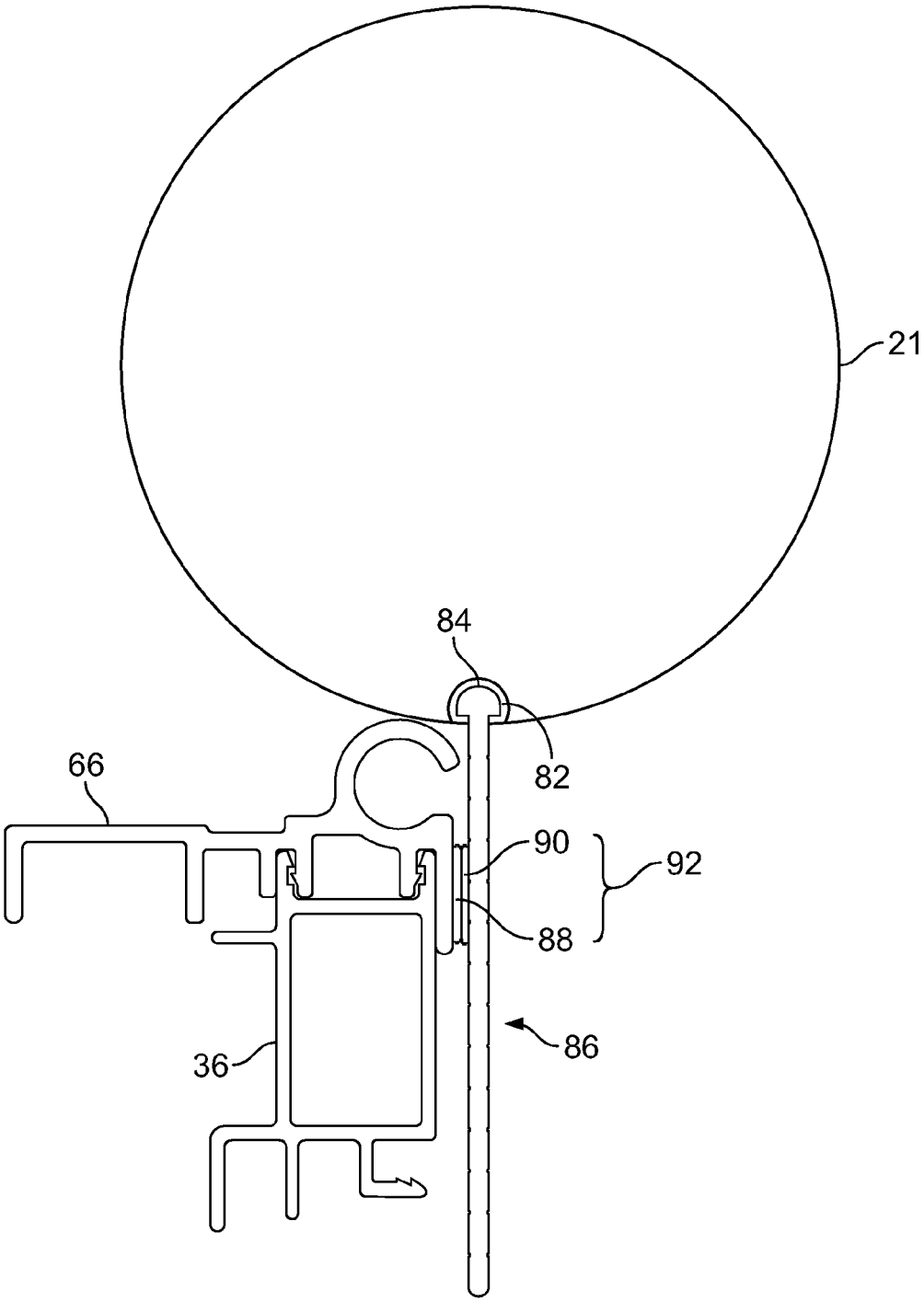
FIG. 8 is a cross-sectional view across the panel frame, the top rail and a roller tube of the awning.
Figure 9:
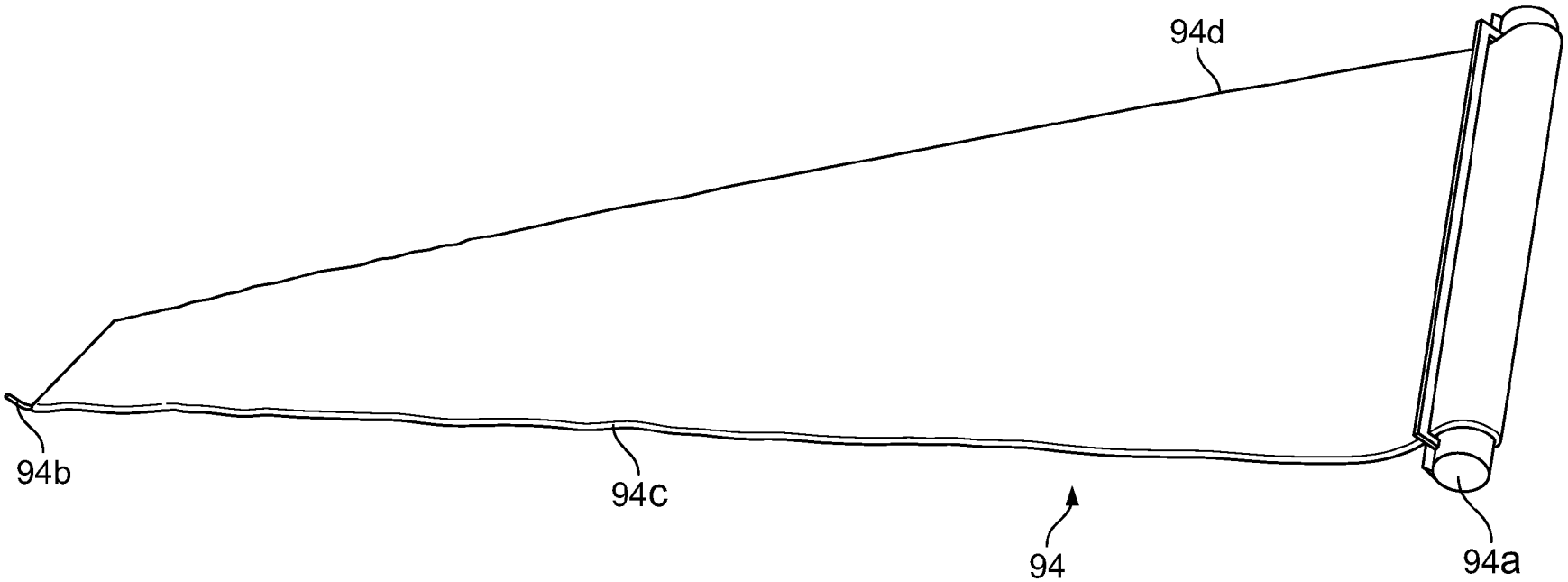
FIG. 9 is a view of a fabric element.

The first patch 88 and the second patch 90 may be adhered to various parts of a component of the assembly through means known in the art (e.g., adhesive). The first and second patches 88, 90 may include adhesive surfaces such that the first patch 88 and the second patch 90 can be affixed to any part of a component of the assembly. In this embodiment, the fastener 92 is mounted on various parts of the U-shaped top rail 66. For example, the first patch 88 is secured to the top rail 66 along a front of the top rail 66 while the second patch 90 is secured to the valance 86. Thus, when the roller tube 21 is extended out so as to be above the top rail 66, the first patch 88 and the second patch 90 can become interlocked to affix the valance 86 to the front of the top rail 66 using the second detachable connection as shown in FIG. 8.

Figure 10:
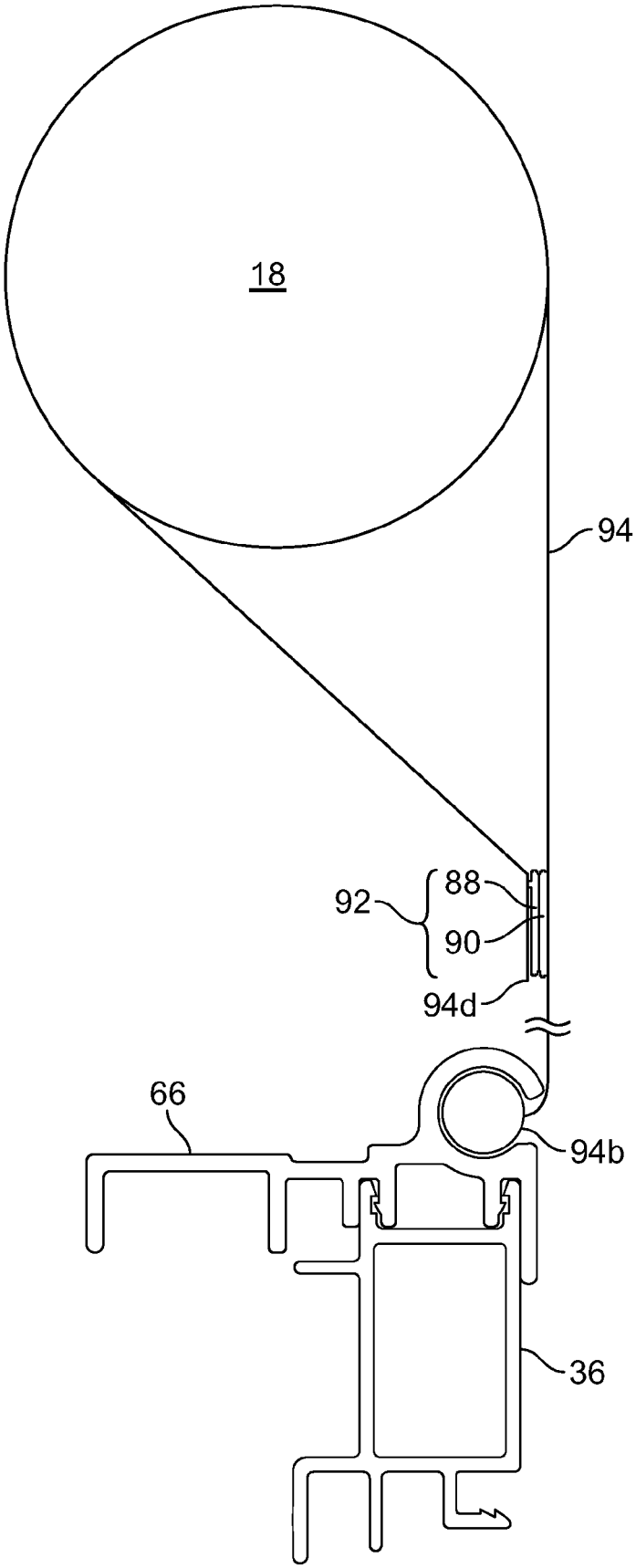
FIG. 10 is a cross-sectional view across the panel frame, the top rail and a member of the awning.

Along the sides of the top rail 66, a substantially triangular or trapezoidal fabric element 94 is used to conceal a gap or opening between the roof structure 16 and the partition 26. The fabric element 94 includes a column 94*a* that is configured to be upright when the fabric element 94 is mounted. The fabric element 94 may include a poly rope 94*b* that extends along a bottom edge 94*c* thereof. The top rail 66 may also include on an outer side of the top rail 66 a C-shaped section 78 in which the poly rope 94*b* of the fabric element 94 can be fitted through a snap-in connection (i.e., a third detachable connection). As shown in FIG. 10, a top portion 94*d* of the fabric element 94 can be folded around one of the members 18 of the roof structure 16 and secured using the fastener 92 for the second detachable connection similarly as discussed above. It may be possible to cut off an undesirable remaining part of the fabric element 94.

In case the room 10 is formed adjacent a structure with a raised platform (e.g., a trailer) such that the wall surface 24 does not provide complete closure and makes the room 10 susceptible to insects, dirt or the like from the outside along the wall surface 24, it may be possible to attach a skirt along the wall surface 24 so as to cover up the openings below the raised platform. Such a skirt may be attached to the wall surface 24 using the fastener 92 for the second detachable connection.

The components of this assembly may be made of materials that provide flexibility, rigidity, endurance, corrosion resistance, etc. such as polymers.

Using this assembly for a room 10, it is possible to form an enclosed area 12 that adjoins an inhabitable structure 14 below the roof structure thereof and is shielded from the outdoors. Assembly of the room 10 does not require the use of known fastening means such as screws, nuts and bolts, glue or the like. The detachable connections (e.g., snap-in connections) of the components allow the room 10 to be assembled and disassembled easily without the use of tools. Components such as the wall seal 80 and the valance 86 contribute toward improved shielding of the enclosed area 12 from the outer environment. Moreover, the use of the panel joiners 60 allows the partition 26 to adapt to the undulation or unevenness of the ground on which the room 10 is built such that any gap between the ground and the partition 26 is further reduced.

It will be apparent to those skilled in the art that various modifications and variations can be made without departing from the spirit and scope of the claimed invention.

What is claimed is:

1. An assembly for forming an enclosed area adjoining an inhabitable structure including a roof structure and a wall surface, the assembly including:

a partition including a plurality of panels including a first panel including a first panel lateral edge and a second panel including a second panel lateral edge, the enclosed area bounded laterally by the partition and the wall surface and bounded at a top by the roof structure, at least the first panel and the second panel being detachably connected with one another at the first panel lateral edge and the second panel lateral edge, and the partition being detachably connected to the roof structure, wherein the partition further includes a top rail and a bottom rail such that the plurality of panels can be placed there between, and wherein each of the first panel and the second panel are rectangular and include a top edge configured to be detachably connected to the top rail, and a bottom edge configured to be detachably connected to the bottom rail; and a panel joiner configured to detachably connect the first panel and the second panel at the first panel lateral edge and the second panel lateral edge, the panel joiner including two end members and a corrugated portion there between, the end members configured along opposite ends of the panel joiner, one of the two end members configured to connect to and detach from the first panel lateral edge by the placement in engagement of the one of the two end members with the first panel lateral edge and the detachment from engagement of the one of the two end members with the first panel lateral edge, respectively, in a direction transverse to the first panel lateral edge, the other of the two end members configured to connect to the second panel lateral edge by the placement in engagement of the other of the two end members with the second panel lateral edge and the detachment from engagement of the other of the two end members with the second panel lateral edge, respectively, in a direction transverse to the second panel lateral edge, wherein the first panel lateral edge includes a first set of outward protrusions and one of the two end members further includes a second set of outward protrusions, and wherein one of the first and second sets of outward protrusions includes a recess formed on a surface thereof and the other of the first and second sets of outward protrusions includes a lateral projection on a surface thereof, the recess and projection being complementary to form an interlocking snap-in connection that detachably connects the first panel lateral edge to said one of the two end members; and wherein the top edge of each of the first panel and the second panel includes a set of outward protrusions, and the top rail includes a set of complementary outward protrusions to form an interlocking snap-in connection that detachably connects the top edge of each of the first panel and the second panel to the top rail; and wherein the bottom edge of each of the first panel and the second panel includes a set of outward protrusions, and the bottom rail includes a set of complementary outward protrusions to form an interlocking snap-in connection that detachably connects the bottom edge of each of the first panel and the second panel to the bottom rail.

2. The assembly of claim 1, the roof structure configured as an awning.

3. The assembly of claim 1 the first panel lateral edge comprising a first longitudinal edge of the first panel, and the second panel lateral edge comprising a first longitudinal edge of the second panel.

4. The assembly of claim 1, the corrugated portion configured to extend and retract such that a distance between the end members is variable.

5. The assembly of claim 4, the corrugated portion configured to extend and retract such that the end members are capable of assuming either parallel or non-parallel orientations.

6. The assembly of claim 1, the top rail and the bottom rail substantially mirroring one another in shape and defining a footing of the partition.

7. The assembly of claim 6, the plurality of panels including a third panel including a panel frame formed along a periphery of the third panel, the panel frame of the third panel configured with a respective first element, each of the top rail and the bottom rail including a track, the third panel mounted between the top rail and the bottom rail such that the first element of the panel frame of the third panel engages the track, the first element being slidably movable relative to the track such that the third panel operates as a sliding door, the third panel not connected to the panel joiner.

8. The assembly of claim 1, further including a platform on which the partition is mounted.

9. The assembly of claim 1, the partition including terminal edges abutting against the wall surface, each of the terminal edges including a seal with flaps that can diverge and contact the wall surface.

10. The assembly of claim 1, further including a first patch and a second patch defining a second detachable connection, the first patch and the second patch configured to detachably connect with one another, the first patch and the second patch including an adhesive surface configured to be adhered to a part of the assembly.

11. The assembly of claim 10, the partition including a top rail and the roof structure connected to the top rail through the second detachable connection.

12. The assembly of claim 11, further including a fabric element configured to conceal an opening between the roof structure and the top rail, the fabric element connected to the roof structure through the second detachable connection and connected to the top rail through a third detachable connection.

13. The assembly of claim 12, the third detachable connection being a snap-in connection.

14. The assembly of claim 1, wherein the recess is provided on the first set of outward protrusions, and the projection is provided on the second set of outward protrusions.

15. The assembly of claim 14, wherein each outward protrusion of the first set comprises a recess, and wherein each outward protrusion of the second set comprises a projection.

16. The assembly of claim 1, wherein the outward protrusions of the first set are spaced apart a first distance, and wherein the outward protrusions of the second set are spaced apart a second distance, the first distance being greater than the second distance such that said one of the two end members is received within the first panel lateral edge.

* * * * *